US006508450B2

(12) United States Patent
Hayde

(10) Patent No.: US 6,508,450 B2
(45) Date of Patent: Jan. 21, 2003

(54) HANGING AND TRANSPORT DEVICE

(76) Inventor: George Shandor Hayde, Koempelstrasse 14, 82340 Feldafing (DE)

( * ) Notice: Subject to any disclaimer, the term of this patent is extended or adjusted under 35 U.S.C. 154(b) by 0 days.

(21) Appl. No.: 09/871,528

(22) Filed: May 31, 2001

(65) Prior Publication Data

US 2002/0179803 A1 Dec. 5, 2002

(51) Int. Cl.[7] ..... A47G 1/16

(52) U.S. Cl. ..... 248/489; 248/498; 248/497; 248/493

(58) Field of Search ..... 248/489, 498, 248/497, 493, 207, 911, 912, 506; 206/521, 591, 495, 455; 40/312, 725, 743, 748

(56) References Cited

U.S. PATENT DOCUMENTS 394,144 A * 12/1888 Sword ..... 160/205
1,455,961 A * 5/1923 Maier ..... 248/493
3,251,569 A * 5/1966 Rynearson ..... 248/328
3,285,549 A * 11/1966 Cook ..... 248/320
4,973,021 A * 11/1990 Schuite ..... 248/495
5,226,687 A * 7/1993 Currie ..... 294/1.1
5,806,826 A * 9/1998 Lemire ..... 248/476
5,947,438 A * 9/1999 Lemire ..... 248/476
6,279,257 B1 * 8/2001 Lemire ..... 248/476
6,318,698 B1 * 11/2001 Hansen ..... 248/489

* cited by examiner

*Primary Examiner*—Leslie A. Braun
*Assistant Examiner*—Ingrid Weinhold
(74) *Attorney, Agent, or Firm*—Kajang McManus

(57) ABSTRACT

The hanging device accommodates transport and hanging requirements for an item such as a work of art. In both instances, the item is cushioned from rigors of motion, and both wire hung and nonwire hung articles are accommodated. When no wire is used, the device also accommodates will hanging of the item through use thereof.

1 Claim, 2 Drawing Sheets

FIG. 3
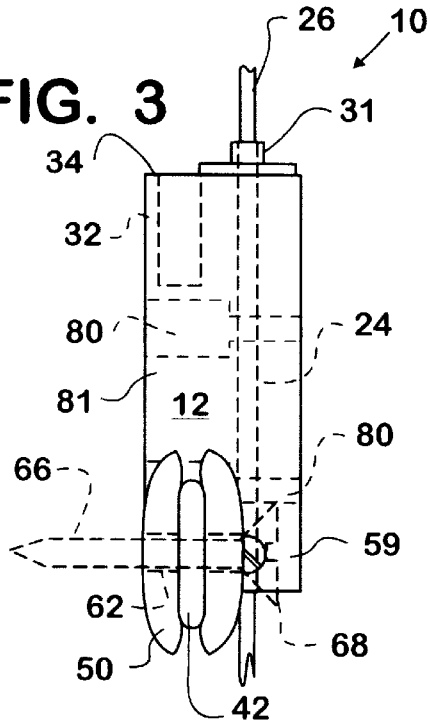
FIG. 1
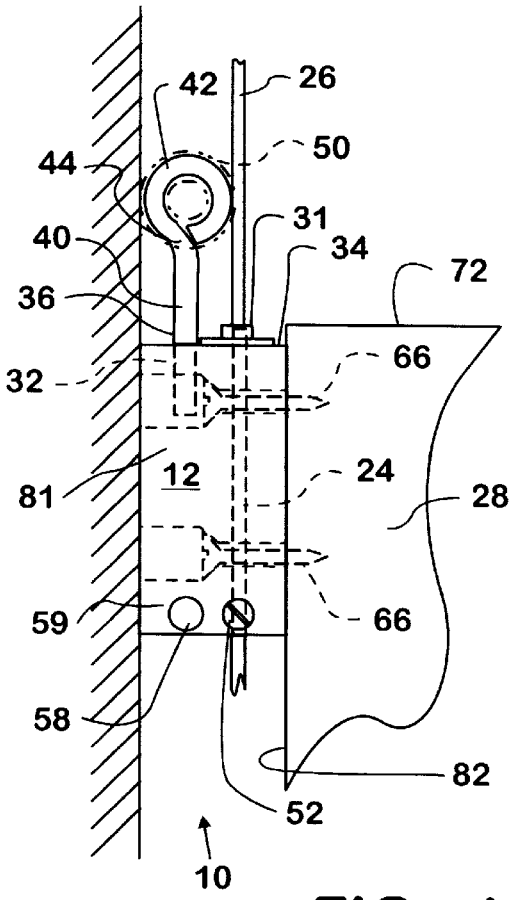
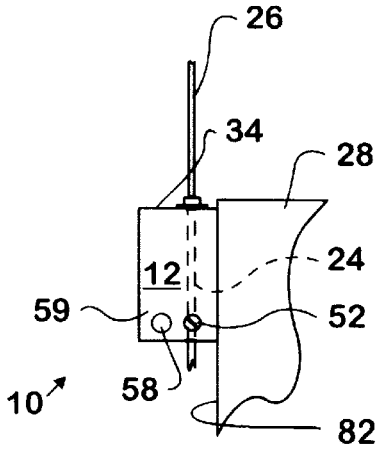
FIG. 2
FIG. 4
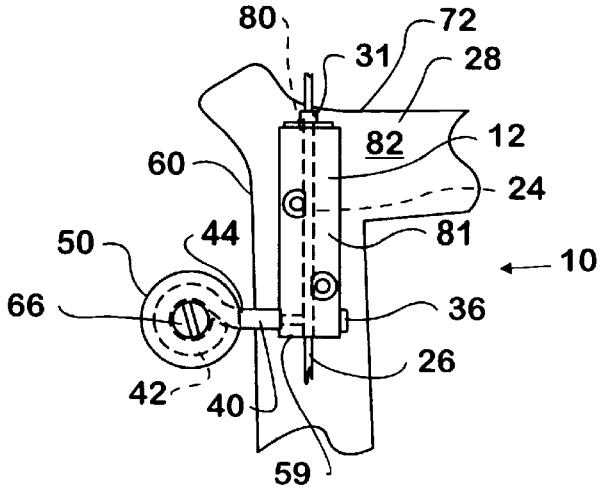

HANGING AND TRANSPORT DEVICE

BACKGROUND OF THE INVENTION

The present invention relates to a device for use in not only hanging but transporting an object, such as a work of art, which may be hung by wires, or not, in a manner where no damage is done to the object while hung or while undergoing rigors of transport.

PRIOR ART

Heretofore various structures have been proposed for hanging an object such as a work of art. However, none to date have been proposed, which can be used to not only hang such work of art, with or without wires, but to also transport the work of art in a manner where it is cushioned within a transportation box against damage imposed by the rigors of transport.

SUMMARY OF THE INVENTION

According to the invention there is provided a hanging device comprising a body having a vertical throughbore therein, having a vertical threaded bore extending thereinto from a top surface thereof and having a horizontal threaded throughbore extending horizontally through a bottom area thereof, each threaded throughbore accommodating a threaded end of an arm having an eyehook at another end of the arm, the eyehook engaging a cushion therearound, with the cushion having a throughbore therein, the throughbore extending within the inner margins of the eyehook and adapted to engage a connector therein, and the body further including at least one horizontal throughbore therein for engaging a connector used to engage the device to an item to be hung thereby.

DESCRIPTION OF THE DRAWINGS

FIG. 1 is a side view showing the device in use in mounting a work of art hung by wire to a wall, with an eye hook thereof, used in transport, shown in a storage position thereof.

FIG. 2 is a side view similar to FIG. 1 but showing the eyehook removed from its storage position.

FIG. 3 is a side view similar to FIGS. 1 and 2 but showing the eyehook of the device in a transport position thereof, with a transport cushion shown engaged within and surrounding the eyehook.

FIG. 4 is a perspective view showing the device engaged to a frame.

DESCRIPTION OF THE PREFERRED EMBODIMENTS

Figure 5:
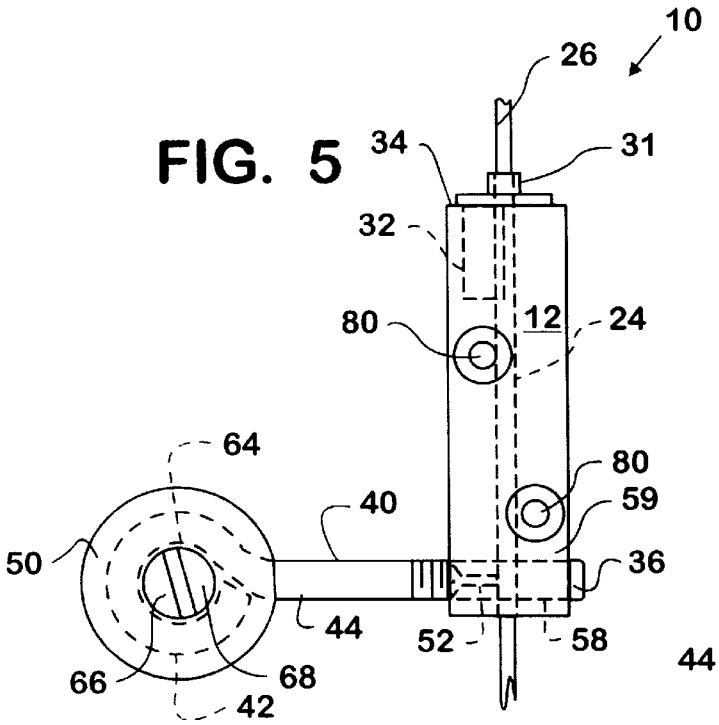
FIG. 5 is an enlarged view of the device of FIG. 4.

Referring now to the drawings in greater detail, there is illustrated therein the hanger device made in accordance with the teachings of the present invention and generally identified by reference numeral 10.

As shown, the device 10 incorporates a body 12 in the form of a rectangular cube.

A throughbore 24 extends vertically therethrough within and through which a wire 26 used for hanging a frame 28 of a work of art is received.

If desired, a collar 31 may be provided, elevated above the throughbore 24, to ease tension on the wire 26 at its point of entry, as shown.

A threaded bore 32 is also provided in the body 12 extending into the upper surface 34 thereof, which threaded bore 32 is sized and configured to receive therein a threaded end 36 of an elongate arm 40 bearing an eyehook 42 on another end 44 thereof. The arm 40 is threaded into the threaded bore 32 to place the arm 40 into a storage position, as shown in FIG. 1.

Engaged within and around the eyehook 42, as shown, is a cushion 50, the purpose of which will be described in greater detail below.

The wire 26, when present, is fixed to the device 10 by means of set screw 52 which traps the wire 26 against an inner surface of throughbore 24 as shown.

Further, the structures of the device 10 are illustrated in transport position in FIGS. 3–6. In this respect, when the arm 40 is removed from the storage position of FIG. 1, it is engaged within a threaded throughbore 58 in a lower area 59 of the body 12, this threaded throughbore 58 extending perpendicularly to the throughbore 24 for the wire 26.

Once seated within the throughbore 58, the arm 40, and more particularly the eyehook 42 with cushion 50 thereover, extends laterally outwardly of an outer side edge 60 of the frame 28 to which the device 10 is attached in a manner shown in FIG. 4, i.e., as close to the outer side edge 60 of the frame 28 as possible.

Now, it will be seen that the cushion 50 incorporates a centered throughbore 62 therein, defined within an inner margin 64 of the eyehook 42, the throughbore 62 being provided to allow a connector 66, such as a screw or bolt 66, having a head 68 of a diameter greater than a diameter of the inner margin 64 of the eyehook 42, for use in securing the device 10, and hence the frame 28 attached thereto, to a transport apparatus or box 70, known in the art.

Figure 6:
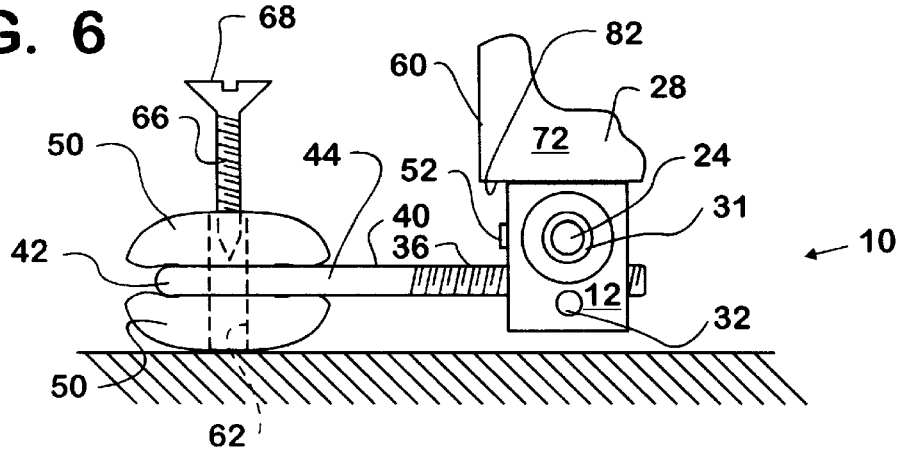
FIG. 6 is a top plan view showing the device engaged between a work of art and having a vertical wall surface, such as that of a transport box.

When attached to the box 70 in the manner shown in FIG. 6, it will be understood that the cushion 50 is interposed between the eyehook 42 and the box 70 to which it is attached, creating a softer, more impact resistant "ride" for the work of art being transported with the device 10.

Although only one device 10 is illustrated in the drawings for the sake of brevity, it will be understood that a pair of such devices 10 will preferably be used for each work of art to be hung or transported.

Figure 7:
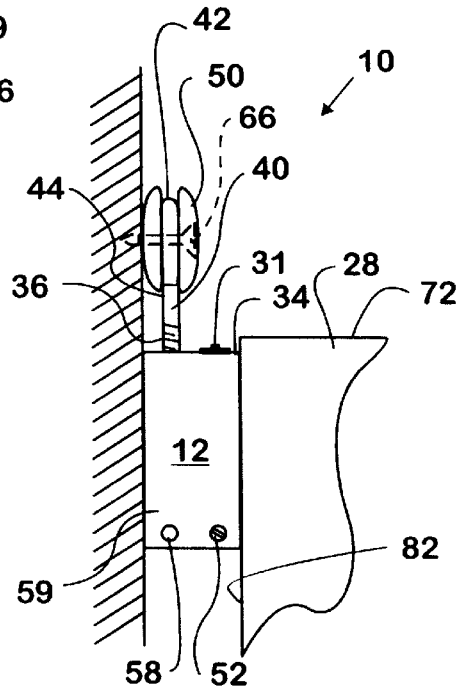
FIG. 7 is a view similar to FIG. 1 but showing the device in use in mounting a work of art which is not wire hung to a wall, using the cushioned eyehook and suitable connector such as a hook or a screw.

Turning now to FIG. 7, it will be seen that the device 10 is also able to be used as a hanging device 10 for a work of art which has no wires for hanging.

In this respect, when the device 10 is mounted as close as possible to an upper edge 72 of the frame 28, as shown best in FIGS. 4 and 7, with the arm 40 engaged in the storage position thereof, extending upwardly from the upper surface 34 of the body 12, the connector 66 may instead be passed through the throughbore 62 in the cushion 50, this time securing the device 10 and hence the frame 28 engaged thereto, to a vertical structure 70, comparable to a transport box 70, such as a wall 70, for hanging and viewing rather than transport.

Accordingly, the device 10 is found to be very accommodating to various known requirements of the art world.

Of course, the device 10 must also be engageable to the frame 28, as defined above, and for this purpose at least one throughbore 80, and preferably a plurality of vertically and horizontally staggered stepped throughbores 80, are provided, extending horizontally through a center body area 81 through which connectors 66 pass and are received in countersunk fashion to engage the device body 12 to the frame 28, and more particularly to a rear surface 82 thereof.

As described above, the device 10 provides a number of advantages, some of which have been described above and others of which are inherent in the invention. Also, modifications may be proposed to the device 10 without departing from the teachings herein. Accordingly, the scope of the invention is only to be limited as necessitated by the accompanying claims.

What is claimed is:

1. A hanging device comprising a body having a vertical throughbore therein, and having a vertical threaded bore extending into the body from a top surface thereof and having a horizontal threaded throughbore extending horizontally through a bottom area thereof, each threaded throughbore accommodating a threaded end of an arm having an eyehook at another end of the arm, the eyehook engaging a cushion therearound, with the cushion having a throughbore therein, the throughbore of the cushion extending within the inner margins of the eyehook and adapted to engage a connector therein, and the body further including at least one horizontal throughbore therein for engaging a further connector used to engage the device to an item to be hung thereby.

* * * * *